United States Patent [19]

Curlee

[11] Patent Number: 4,934,068

[45] Date of Patent: Jun. 19, 1990

[54] HAIR DRYER HEAT DEFLECTOR DEVICE

[76] Inventor: Helen W. Curlee, 2601 Linden Ave., Norman, Okla. 73072

[21] Appl. No.: 350,297

[22] Filed: May 11, 1989

[51] Int. Cl.[5] ..... A45D 20/18

[52] U.S. Cl. ..... 34/99; 34/243 R

[58] Field of Search ..... 34/96, 97, 99, 100, 34/101, 243

[56] References Cited

U.S. PATENT DOCUMENTS 3,168,748 2/1965 Limberg ..... 34/99 X

*Primary Examiner*—Henry A. Bennet

*Attorney, Agent, or Firm*—Laney, Dougherty, Hessin & Beavers

[57] ABSTRACT

A hair dryer heat deflector which includes a forwardly extending, arcuately cross-sectioned bill having a forward edge and a rear edge to which is joined an upwardly extending forehead protector of arcuate cross-sectional configuration to fit the forehead. A pair of cheek protector sections flare outwardly and downwardly from the bill, and a headband or strap is connected to the cheek protector sections on opposite sides of the bill.

2 Claims, 1 Drawing Sheet

HAIR DRYER HEAT DEFLECTOR DEVICE

FIELD OF THE INVENTION

This invention relates to head pieces, and more particularly, to face protective head pieces having a forwardly projecting bill.

BACKGROUND OF THE INVENTION

Brief Description of the Prior Art

Many and varied are the head pieces which have been heretofore proposed for use to aesthetically dress the head, or for the functional purpose of shielding the face from intense sunlight, or for various other purposes. Baseball hats, for example, include elongated bills which extend forward and function to shield the face of the player from the sunlight, both to prevent burning of the face by the sun, and also to permit the eyes to be shaded so that the ball can be better seen and more easily and certainly caught.

Other types of bill-carrying hats and head pieces have been proposed for various usages.

Where a lady is seated under a hair dryer in a beauty salon, some of the hot air used for drying the hair blows from the dryer down around the sides of the head and face of the customer, causing considerable discomfort to the customer over the extended period of hair drying. A device which would alleviate this discomfort and unhealthful exposure to the inhalation of hot dry air would be highly useful.

BRIEF DESCRIPTION OF THE PRESENT INVENTION

The present invention provides a head piece which may be comfortably worn, which exposes the top side of the head so that a hair dryer can be placed over the hair, and which functions, by its inclusion of certain deflector parts, to deflect air away from the face and cheeks of the person who is undergoing the drying of the hair in a beauty salon, and to allow the hair drying to be carried out over the required period of time without a high level of discomfort being experienced by the customer.

Broadly described, the hair dryer heat deflector device of the invention includes a forwardly extending, arcuately cross-sectioned bill or face protector plate which is concavely shaped on its under side, and which projects across the head from one side thereof to the other, and extends forwardly from its point of contact with the head. The bill preferably merges or flows smoothly into a pair of cheek protector wings which are formed integrally therewith, and which project laterally out over the cheeks and function to deflect hot air away from the cheeks.

The hair dryer heat deflector device of the invention further includes an upwardly extending forehead protector panel. This panel is curved or arcuate in cross-sectional configuration so as to fit the forehead of the wearer of the device. On the inner side of the forehead panel, which projects upwardly from the bill of the head piece, there is secured a foam rubber pad with an internal cloth liner. This pad and liner structure substantially enhances the comfort of the user against whom the forehead panel is pulled and bears with some significant force during wearing of the device, and it also functions to absorb perspiration which, of course, the person undergoing drying of the hair tends to copeously generate during the drying operation.

The forehead panel which is joined to the bill will normally have a height of from about one inch to about three inches, but preferably is about one and one-half inches in height in order to allow adequate room for the dryer to be placed over the hair, and the bill to be elevated adequately above the eyes so as not to impair vision.

The head piece carries a headband or strap which may be a one or two-part structural element which functions to secure the head piece on the head by extension of the headband around the head of the wearer.

An important object of the present invention is to provide a hair dryer heat deflector device which is a specially configured, highly utilitarian head piece which will, when worn, deflect hot air from a hair dryer worn by a customer away from the entire face of the customer, and allow the customer's face to remain cool during the drying of the hair.

Another object of the invention is to provide a hair dryer heat deflector device which can be manufactured without substantial expense, and which can be afforded by persons of sufficient means to, from time to time, retain the services of a professional beautician for care of the hair.

Another object of the invention is to provide a hair dryer heat deflector device which includes a forwardly extending bill and an upwardly extending forehead panel, with the forehead panel being lined with a material which bears softly against the forehead when the device is worn on the head, and which liner material also functions to absorb perspiration during the drying of the hair.

Additional objects and advantages of the present invention will become apparent as the following detailed description of the invention is read in conjunction with the accompanying drawings which illustrate a preferred embodiment of the invention.

BROAD DESCRIPTION OF THE DRAWINGS

DETAILED DESCRIPTION OF A PREFERRED EMBODIMENT OF THE INVENTION

Figure 4:
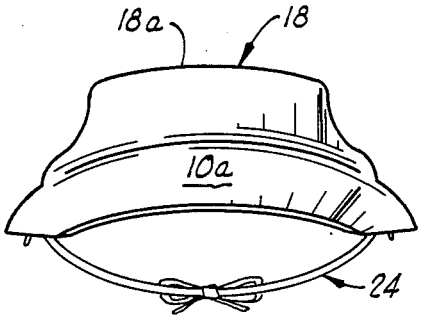
FIG. 4 is a front elevation view of the hair dryer heat deflector device of the invention.
Figure 5:
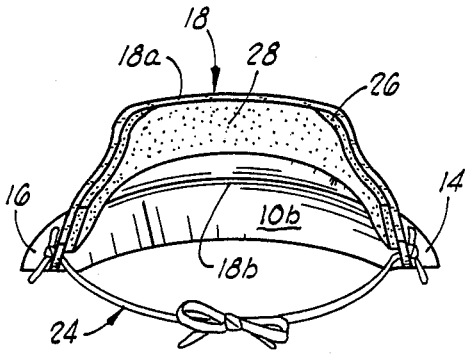
FIG. 5 is a rear elevation view of the hair dryer heat deflector device of the invention.

The hair dryer heat deflector device of the invention includes a bill 10 which is an arcuate panel having a concave downwardly facing side 10*a*, a convex upwardly facing side 10*b* and an arcuate forward edge 10*c*. The bill 10 generally projects substantially horizontally and is cupped or arcuate in its cross-sectional configuration, so as to deflect the hot air which may be directed downwardly by the hair dryer device on the head of the customer, and cause such hot air to move away from the face of the customer. The bill 10 merges with a pair of lateral, cheek protector wings 14 and 16 which flare outwardly and have convexly curved outer edges 14*a* and 16*a*, respectively. The way the wings 14 and 16 merge smoothly into the bill 10 as can best be perceived by reference to FIGS. 1, 2 and 4.

Figure 1:
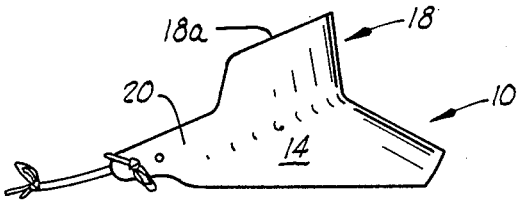
FIG. 1 is a side elevation view of the hair dryer heat deflector device of the invention.
Figure 2:
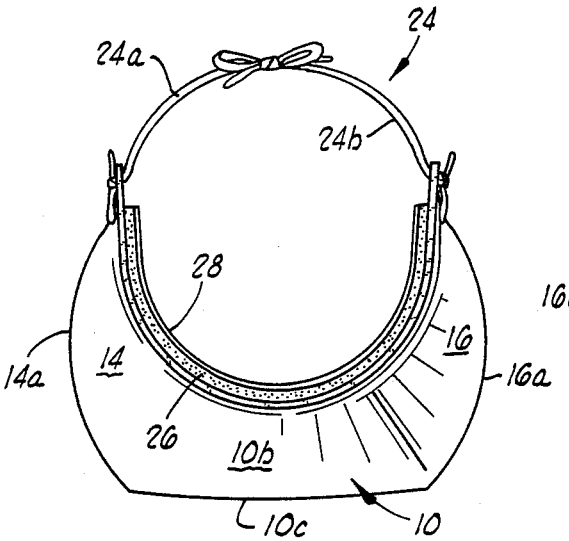
FIG. 2 is a top plan view of the hair dryer heat deflector device of the invention.
Figure 3:
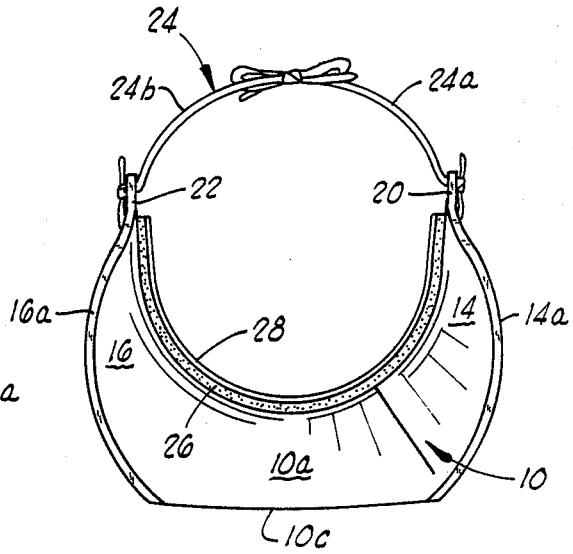
FIG. 3 is a bottom plan view of the hair dryer heat deflector device shown in FIGS. 1 and 2.

Projecting upwardly from the rear edge of the bill 10 is a forehead panel 18. The forehead panel includes an arcuate or curved upper edge 18*a*, and an arcuate or curved lower edge 18*b* which is joined to the curved rear edge of the bill 10. The forehead panel 18 is joined to, and preferably is formed integrally with, a pair of rearwardly extending ear pieces 20 and 22 as best illustrated in FIGS. 1–3 of the drawings. The ear pieces 20 and 22 each define a pair of holes to permit selective engagement of the ends of a headband structure, designated generally by reference numeral 24. The headband structure 24 may be variously constructed, and may include a pair of parts 24*a* and 24*b*, each constructed of a flexible, though inelastic strap, and the two straps collectively being of a length such that the two straps can be tied behind the head to secure the heat deflector device in place. Alternatively, a single band of a flexible and elastic material can be utilized for the headband structure 24.

To enhance the comfort to the wearer of the device and to prevent perspiration from gravitating from the hair line downwardly across the forehead and into the eyes of the person undergoing the drying of the hair, the forehead panel 18 has secured to the inner side thereof a foam rubber pad or panel 26 which is of complementary configuration to the forehead panel 18. The foam rubber panel 26 is lined with a soft fabric covering 28.

In the use of the hair dryer heat deflector device of the invention, the device is secured in place with the forehead panel 18 bearing against the forehead of the user. The bill 10 projects outwardly from its location over the eyes after the head piece of the hair dryer apparatus has been placed in position over the hair of the customer. With the heat deflector device in place, hot air blasts which escape from the hair dryer bowl and by-pass the hair of the user are deflected away from the face and cheeks of the customer, so that the customer remains comfortable while the hair is undergoing drying.

Although a preferred embodiment of the invention has been herein described in order to provide guidelines to those skilled in the art relative to the use of the principles of the invention, it will be understood that various changes and innovations in the illustrated and described structure can be made without departure from these basic principles. Changes and innovations of this type are therefore deemed to be circumscribed by the spirit and scope of the invention, except as the same is limited by the appended claims or reasonable equivalents thereof.

What is claimed is:

1. A hair dryer heat deflector device comprising:

a bill of arcuate configuration including:

a concave lower surface;

a convex upper surface;

a forward edge; and a rear edge;

a forehead panel projecting upwardly from said bill and having a generally semi-circular arcuate configuration, said forehead panel including a central section having:

an upper edge;

a lower edge joined to the rear edge of said bill;

a concave inner side; and a convex outer side; and said forehead panel further including a pair of opposed ear pieces on opposite sides of said central section;

a moisture absorbant pad secured to, and lining, the concave inner side of the central section of said forehead panel; and headband means secured to said ear pieces and adapted for extending around the back of the head to hold the heat deflector device on the head; and a pair of cheek protective wings secured to said bill on opposite sides thereof and projecting downwardly and rearwardly therefrom and each having a substantial portion lying outwardly of a line extending from the point of attachment of the headband means to said ear pieces to a tangent point on the convex outer side of the central section of the forehead panel so as to overhang the cheeks and deflect heat away from the cheeks.

2. A hair dryer heat delfector device as defined in claim 1 wherein said moisture absorbant pad comprises:

a foam rubber panel; and a soft fabric sheet covering the inner side of said foam rubber panel.

* * * * *